US008282020B2

(12) United States Patent
Kiss et al.

(10) Patent No.: US 8,282,020 B2
(45) Date of Patent: Oct. 9, 2012

(54) THREE-WAY VALVES AND FUEL INJECTORS USING THE SAME

(75) Inventors: Tibor Kiss, Manitou Springs, CO (US); Randall James Strauss, Colorado Springs, CO (US); James A. Pena, Encinitas, CA (US); John Mathew Quinlan, Woodland Park, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 0 days.

(21) Appl. No.: 13/290,817

(22) Filed: Nov. 7, 2011

(65) Prior Publication Data

US 2012/0080110 A1 Apr. 5, 2012

Related U.S. Application Data

(63) Continuation of application No. 11/313,861, filed on Dec. 20, 2005, now Pat. No. 8,196,844.

(60) Provisional application No. 60/638,896, filed on Dec. 21, 2004.

(51) Int. Cl.
*F02M 47/02* (2006.01)

(52) U.S. Cl. ..... 239/88; 239/124

(58) Field of Classification Search ..... 239/88–96, 239/124, 126, 533.2, 533.3, 533.8, 533.12, 239/584, 585.5; 251/129.15, 129.21, 127; 137/107

See application file for complete search history.

(56) References Cited

U.S. PATENT DOCUMENTS 2,751,923 A 6/1956 Towler et al.
2,837,148 A 6/1958 Jay
2,971,090 A 2/1961 Piet et al.
3,036,598 A 5/1962 Smith et al.
3,202,182 A 8/1965 Haviland
3,339,586 A 9/1967 Tenkku et al.
3,527,253 A 9/1970 Harpman
3,720,221 A 3/1973 Hufeld et al.
3,741,247 A 6/1973 Kaemmer
3,743,898 A 7/1973 Sturman (Continued)

FOREIGN PATENT DOCUMENTS

DE 1803578 7/1970

(Continued)

OTHER PUBLICATIONS

Godlove, Terry F., et al., "Printed-Circuit Quadrupole Design", *Proceedings of the 1995 Particle Accelerator Conference*, vol. 4, (May 1-5, 1995), pp. 2117-2119.

*Primary Examiner* — Davis Hwu
(74) *Attorney, Agent, or Firm* — Blakely Sokoloff Taylor & Zafman LLP

(57) ABSTRACT

Three-way valves having reduced leakage and fuel injectors using the same. Three-way spool poppet valves are disclosed having a spool with a poppet valve thereon cooperating with a seat on the valve housing to provide a substantially leak free valve closing in one direction characteristic of a poppet valve while preserving the advantages of a spool valve. Three-way ball valves are also disclosed having substantially leak free valves closing in both directions, but further including reduced short circuit losses due to direct flow from a high pressure source to a low pressure vent during transition of the ball from one position to the opposite position. Fuel injectors with direct needle control using the three-way valves of the present invention are also disclosed.

10 Claims, 7 Drawing Sheets

U.S. PATENT DOCUMENTS

| | | | |
|---|---|---|---|
| 3,768,517 | A | 10/1973 | Pauliukonis |
| 3,776,275 | A | 12/1973 | Updike |
| 4,004,603 | A | 1/1977 | Jones |
| 4,016,716 | A | 4/1977 | Evans et al. |
| 4,298,027 | A | 11/1981 | Neff |
| 4,332,368 | A | 6/1982 | Woloszczuk |
| 4,641,118 | A | 2/1987 | Hirose et al. |
| 4,823,825 | A | 4/1989 | Buchl |
| 4,880,033 | A | 11/1989 | Neff |
| 5,193,781 | A | 3/1993 | Willbanks |
| 5,207,059 | A | 5/1993 | Schexnayder |
| 5,211,198 | A | 5/1993 | Tinholt |
| 5,213,133 | A | 5/1993 | Ellett |
| 5,351,601 | A | 10/1994 | Zeuner et al. |
| 5,460,329 | A | 10/1995 | Sturman |
| 5,463,996 | A | 11/1995 | Maley et al. |
| 5,485,957 | A | 1/1996 | Sturman |
| 5,497,806 | A | 3/1996 | Swank et al. |
| 5,640,987 | A | 6/1997 | Sturman |
| 5,673,669 | A | 10/1997 | Maley et al. |
| 5,697,342 | A | 12/1997 | Anderson et al. |
| 5,918,635 | A | 7/1999 | Wang et al. |
| 5,970,956 | A | 10/1999 | Sturman |
| 6,012,644 | A | 1/2000 | Sturman et al. |
| 6,038,957 | A | 3/2000 | Ertmann et al. |
| 6,082,332 | A | 7/2000 | Hefler et al. |
| 6,085,991 | A | 7/2000 | Sturman |
| 6,145,806 | A | 11/2000 | Dettmann |
| 6,161,770 | A | 12/2000 | Sturman |
| 6,170,524 | B1 | 1/2001 | Gray, Jr. |
| 6,174,219 | B1 | 1/2001 | Mathews |
| 6,209,565 | B1 | 4/2001 | Hughes et al. |
| 6,209,577 | B1 | 4/2001 | Lai et al. |
| 6,257,499 | B1 | 7/2001 | Sturman |
| 6,360,728 | B1 | 3/2002 | Sturman |
| 6,371,382 | B1 | 4/2002 | Niethammer et al. |
| 6,425,375 | B1 | 7/2002 | Hefler et al. |
| 6,655,602 | B2 | 12/2003 | Shafer et al. |
| 6,668,861 | B2 | 12/2003 | Williams |
| 6,715,694 | B2 | 4/2004 | Gebhardt |
| 6,739,293 | B2 | 5/2004 | Turner et al. |
| 6,749,130 | B2 | 6/2004 | Cotton |
| 6,806,793 | B2 | 10/2004 | Pillai et al. |
| 6,837,451 | B2 | 1/2005 | Rodriguez-Amaya et al. |
| 6,918,409 | B1 | 7/2005 | Parker |
| 6,957,664 | B2 | 10/2005 | Suilmann et al. |
| 7,032,574 | B2 | 4/2006 | Sturman |
| 7,210,501 | B2 | 5/2007 | Neff et al |
| 2002/0029765 | A1 | 3/2002 | Giavi et al. |
| 2003/0155437 | A1 | 8/2003 | Lei |
| 2004/0149264 | A1 | 8/2004 | Pecheny et al. |
| 2004/0188537 | A1 | 9/2004 | Sturman |
| 2004/0238657 | A1 | 12/2004 | Sturman |
| 2007/0113906 | A1 | 5/2007 | Sturman et al. |
| 2007/0246014 | A1 | 10/2007 | Pena et al. |
| 2007/0267076 | A1 | 11/2007 | Strauss et al. |

FOREIGN PATENT DOCUMENTS

| | | |
|---|---|---|
| EP | 0621426 | 10/1994 |
| FR | 2180789 | 11/1973 |
| FR | 2354499 | 1/1978 |
| GB | 631750 | 11/1949 |
| GB | 2352798 | 2/2001 |
| JP | 2002-351306 | 12/2002 |

THREE-WAY VALVES AND FUEL INJECTORS USING THE SAME

CROSS-REFERENCE TO RELATED APPLICATION

This application is a continuation of U.S. patent application Ser. No. 11/313,861 filed Dec. 20, 2005, published as U.S. Patent Application Publication No. 2006/0157581, which claims the benefit of U.S. Provisional Patent Application No. 60/638,896 filed Dec. 21, 2004.

STATEMENT OF GOVERNMENT INTEREST

The U.S. Government has certain rights in this invention pursuant to Contract No. W56HZV-04-C-0677 awarded by the United States Army.

BACKGROUND OF THE INVENTION

1. Field of the Invention

The present invention relates to the field of three-way valves, and fuel injectors using three-way valves.

2. Prior Art

Embodiments of the present invention provide improved devices for fluid control in various applications. A typical example is the control of a high pressure fuel injector. Typically, two-way poppet valves (open and closed) are used due to their superior leakage characteristics (low) and the ability to pressure balance a two-way poppet valve. It is highly desirable to use a three-way valve for improved performance and control, but this is difficult due to a three-way valve's inability to pressure balance completely unless it is a spool valve, which leaks excessively. For purposes of this disclosure, a three-way valve will be described as a valve coupling a supply (S) passage to a control (C) passage or coupling the control passage to a vent (V), though other port identifications may be more appropriate depending on the use of the three-way valve.

The choices for a three-way valve are:

Spool valve. A spool valve can create the required hydraulic paths, but while in either position (S-C or C-V) the valve has a very short leak (seal) path from a high-pressure area to a vented area, which can lead to high system parasitic losses. This valve can be designed to have a hydraulic short circuit (momentarily coupling of supply and vent when transitioning from one position to the other) or not, depending on the application. The advantages are primarily in its pressure balance, thereby requiring very low actuation forces, and in the ability to be designed to avoid the short circuit.

Three-way hard-seat valve (Poppet). This type of valve can have no leakage in either position, but when the valve is transitioning from one position to the other, there necessarily exists a direct flow path between the supply and the vent that could lead to large losses of energy and system noise. This type of valve cannot be completely pressure balanced, and therefore requires more actuating forces than a typical pressure balanced spool valve.

Two two-way hard-seat valves (Poppet). This option has no leakage and can have a direct flow path between the supply and the vent or not, depending on control of the system. The disadvantage of this system is that twice as many control valves are needed to achieve three-way control, adding system and control complexity, and further requires more room to package.

Thus the current choices and their disadvantages are:

Spool Valve: High static leakage.

Three-way hard-seat valve: High actuating force requirements (due to pressure imbalance) and short circuit loss.

Two, two-way hard seat valves: Cost and complexity.

Also known are three-way ball valves. Here a ball is moveable from one seat to an opposing seat, allowing fluid communication between a port at the side of the ball through whichever seat is uncovered by the ball. With the supply of pressure through one seat and the control at the side of the ball and the vent through the other seat, there is a momentary flow path between the supply and the vent during the transition of the ball from one seat to the other.

DETAILED DESCRIPTION OF THE PREFERRED EMBODIMENTS

Figure 1:
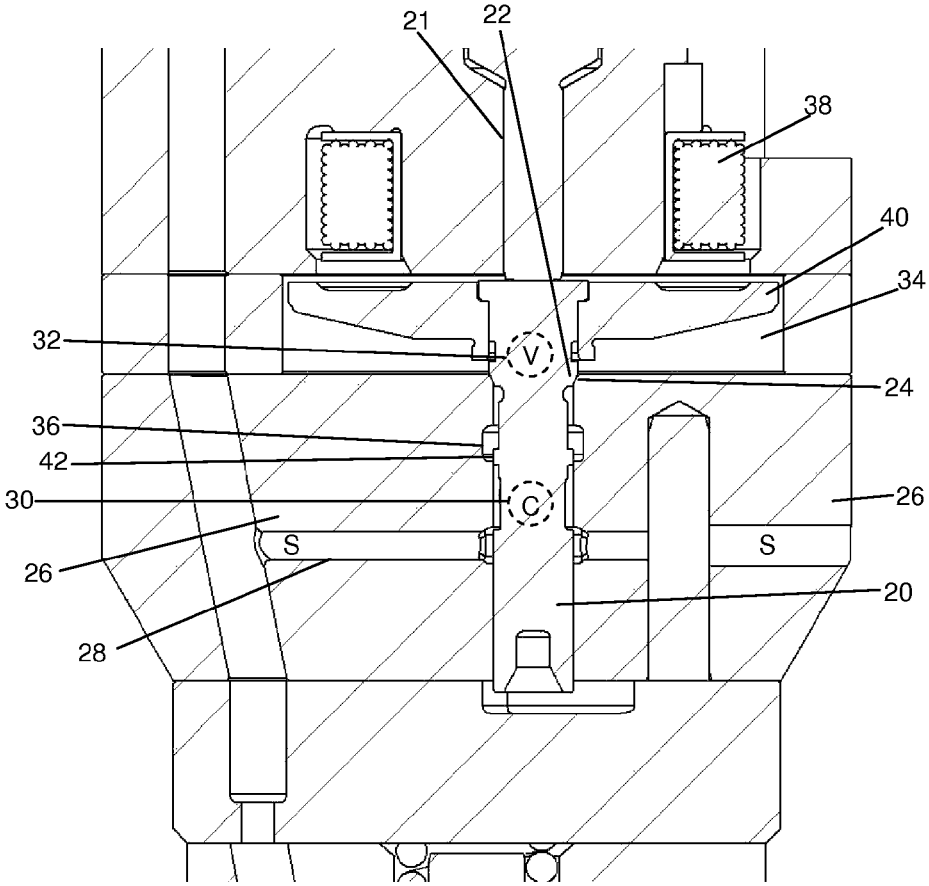
FIG. 1 is a cross-section of a three-way spool poppet valve in accordance with one embodiment of the present invention.

First referring to FIG. 1, a preferred embodiment of a three-way spool poppet valve in accordance with the present invention may be seen. The valve is comprised of a spool 20 having a poppet valve 22 at one end thereof, cooperating with a poppet valve seat 24 at the end of the spool valve housing 26. The valve itself is coupled to supply (S) port 28 (a second port), a control (C) port 30 (a first port), and a vent (V) port 32 that vents region 34 to a low pressure, which may or may not be equal to atmospheric pressure. The various ports are labeled as supply, control and vent, as one particular embodiment shown is used to control pressure over a hydraulic surface, in one case over the needle of a intensifier type fuel injector to provide direct needle control for the injector, and in another case to control pressure over a hydraulic actuator for a three-way ball valve. In other applications, more appropriate port identifications might be used. Also in FIG. 1, a groove 36 is provided in the spool housing, though is not coupled to any functional port.

In the position shown, the spool 20 is pushed downward by spring loaded or hydraulically actuated member 21 and is in its lowermost position, closing the poppet valve 22 against the poppet valve seat 24 at the upper region thereof. This prevents leakage of any fluid through the small gaps of the spool valve out that end to the vent. In this position, the spool 20 allows fluid communication between the supply port 28 and the control port 30, which in the direct injector needle control application, keeps the injector needle closed in spite of the intensified fuel pressure surrounding the needle.

In the embodiment shown, when solenoid coil 38 is activated, armature member 40 rises, pulling spool member 20 upward. During the first part of the upward movement of the spool 20, the poppet valve begins to open, even before the spool 20 moves upward far enough to close the flow path between the supply port 28 and the control port 30. However during this time, land 42 blocks free communication between the control port 30 and the vent 32,34 until fluid communication between the supply port 28 and the control port 30 is blocked by the spool valve. Then land 42 will move entirely into the vicinity of relief 36, now allowing free fluid communication between the control port 30 and the vent 32,34. Thus the three-way spool poppet valve of the present invention combines the leak-proof performance of a poppet valve with a spool valve, but at the same time eliminating the usual short circuit, that is, the momentary fluid communication between a supply port and a vent port characteristic of a three-way poppet valve.

Figure 2:
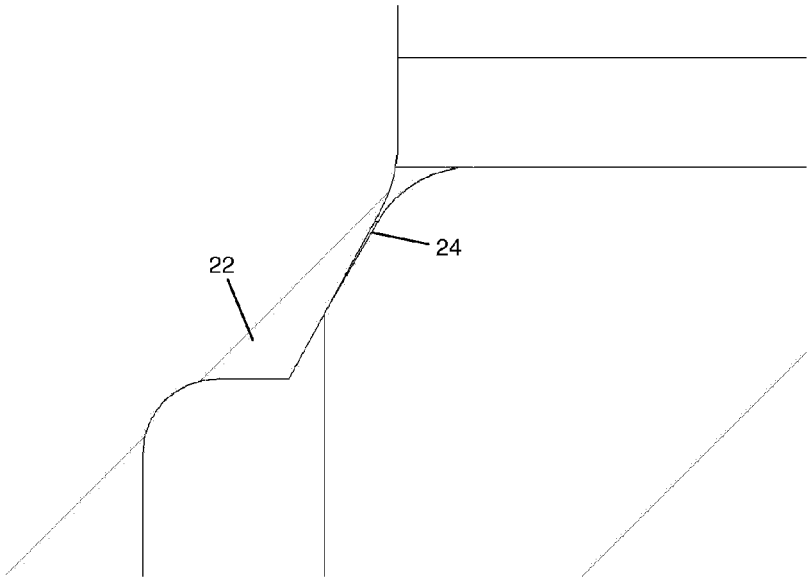
FIG. 2 is an illustration of the difference in mating angles of the spool poppet valve and respective poppet valve seat.

The spool poppet valve of the present invention will remain substantially pressure balanced even with a substantial pressure on the poppet valve itself. In particular, referring to FIG. 2, the angle on the poppet valve member 22 is slightly greater than the angle on the poppet valve seat 24. Consequently, sealing occurs at the diameter of the spool to preserve the pressure balance. Even with wear at the point of contact, sealing will occur substantially at that diameter to preserve the pressure balance.

Thus this embodiment of the invention creates a three-way hydraulic control valve using a unique combination of a poppet seat and a spool valve. The valve is normally on the poppet seat. On the guide portion of the valve, a port exists, creating a spool valve for the third way flow. Since the porting is arranged to flow from supply to control in this position, leakage is controlled by a long guide and the poppet seat and is therefore very low. Additionally (by way of another relief on the guide portion of the valve) this valve can now eliminate the hydraulic short circuit (HSC) of supply fluid to vent while the valve is transitioning from one position to the other (i.e. supply-control to control-vent). This is unique and beneficial also in the sense that the valve does not need to close on the poppet seat against flow across the poppet seat, as all flow to vent, other than spool valve leakage, is stopped by the spool valve. Thus this valve combines the advantages of a spool valve (low actuation forces due to pressure balance and possibility of no short circuit) with the advantages of a two-way poppet (pressure balance and low leak condition). Thus the valve requires low actuation forces due to pressure balance (for optimum packaging and low mass), low leakage and the option of no short circuit. This valve can therefore be a three-way valve used at very high pressures where a poppet valve is typically used, but only as a two-way. A pressure balanced, three-way, low leakage valve is highly desired for fuel system applications as one example, for direct control of needle motion in a diesel fuel injector.

Figure 3:
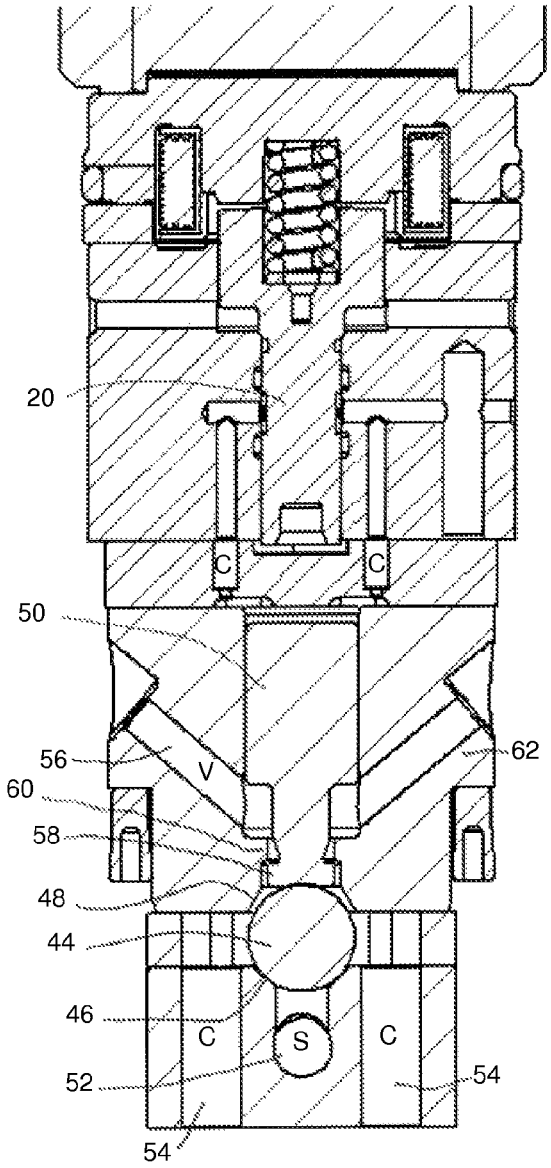
FIG. 3 is a cross-section of a three-way ball valve in accordance with another embodiment of the present invention.

An alternate embodiment is shown in FIG. 3. In this Figure, parts with the same function as parts identified in FIG. 1 are identified with the same numerals, even though the configuration of the parts may differ. The ports supply (S), control (C) and vent(v) are also labeled. The upper region 21 of spool 20 is relieved out of the plane of the cross-section to couple the control (C) to vent (v) when the spool 20 moves upward to open the poppet valve.

There are various ways of actuating the valves of the type represented in FIGS. 1 and 3. One is through an integrated magnetic end of the valve (20' of FIG. 3). Another is with a separate armature 40 attached to the valve as in FIG. 1. In each case, the actuation can take place with one actuator and a spring return 21' as in FIG. 3, or with two actuators, one for driving the valve in each direction. If electrically actuated, the valve requires little electric power, and in general is simple, has very high speed, and a low mass in a small package. The actuator could be, by way of example, solenoids of E-core or Pot-core configurations or mechanical or piezoelectric, to name a few. Also if desired, an O-ring could be used on the spool or in the spool housing opposite the poppet valve to prevent leakage at that location also.

Another form of novel three-way valve may be seen in FIG. 3. Here, a three-way ball valve is shown. Ball 44 is captured between two seats 46 and 48, being held against seat 46 by hydraulically actuated piston 50. Again using the same port designations, the high pressure supply (S) port 52 is below seat 46, the control (C) port 54 is adjacent the sides of the ball 44, and the vent (V) port 56 is above seat 48. With the ball in the position shown, the supply port is blocked and the control port and vent are in fluid communication. When the top of piston 50 is vented, the differential pressure between the supply pressure in port 52 and the vent 56 will push the ball upward to rest against seat 48 and seal port 56. Normally in a ball valve of this type, the ball motion is substantial in order to provide adequate flow passages from the open port around the ball, providing a substantial short circuit, i.e., time during which a substantial flow passage exists between the supply and the vent. In the novel ball valve of FIG. 3, piston 50 has an integral spool valve-like land 58 on its end which cooperates with the land 60 on the inside of body member 62. These perform like a normal spool valve, opening enough with the ball 44 in the lower position to provide an adequate flow passage between the control port 54 and the vent 56, but immediately beginning to close, and closing during the early part of the vertical motion of the ball to substantially limit the time and flow passage area during which the supply port 52 is in fluid communication with the vent port 56. Thus the short circuit characteristic of such ball valves is not eliminated, but its effect is substantially reduced, thereby substantially improving the performance of the valve. There are various ways of actuating the valve. The valve is not pressure balanced and therefore needs only to be actuated in one direction and will return to the original position once actuating force is removed. The actuating force could be generated by any of many different types of actuators, including hydraulic, magnetic and piezoelectric, hydraulic being shown in the fuel injector application herein described.

Figure 4:
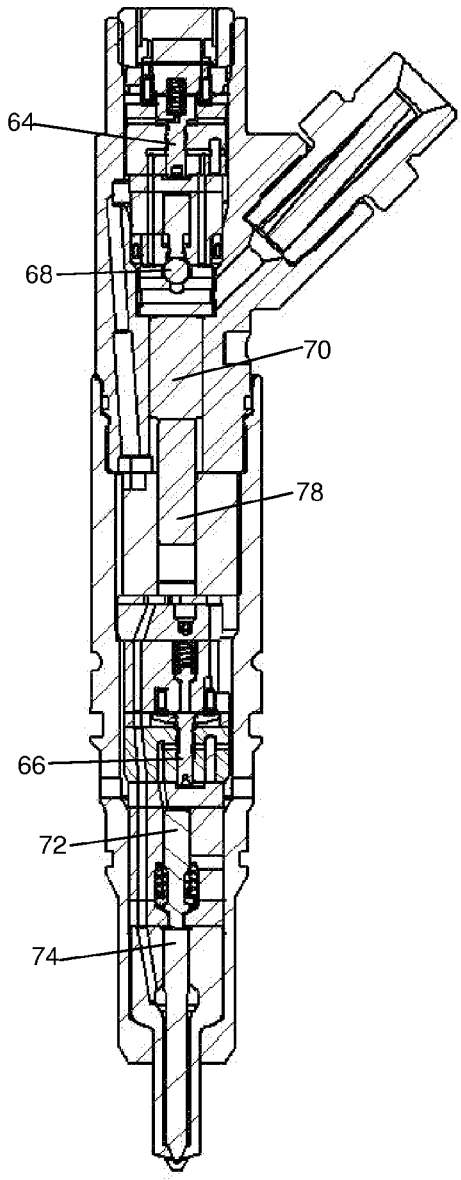
FIG. 4 is a cross-section of an injector incorporating the three-way spool poppet valves and three-way ball valve of the present invention.
Figure 5:
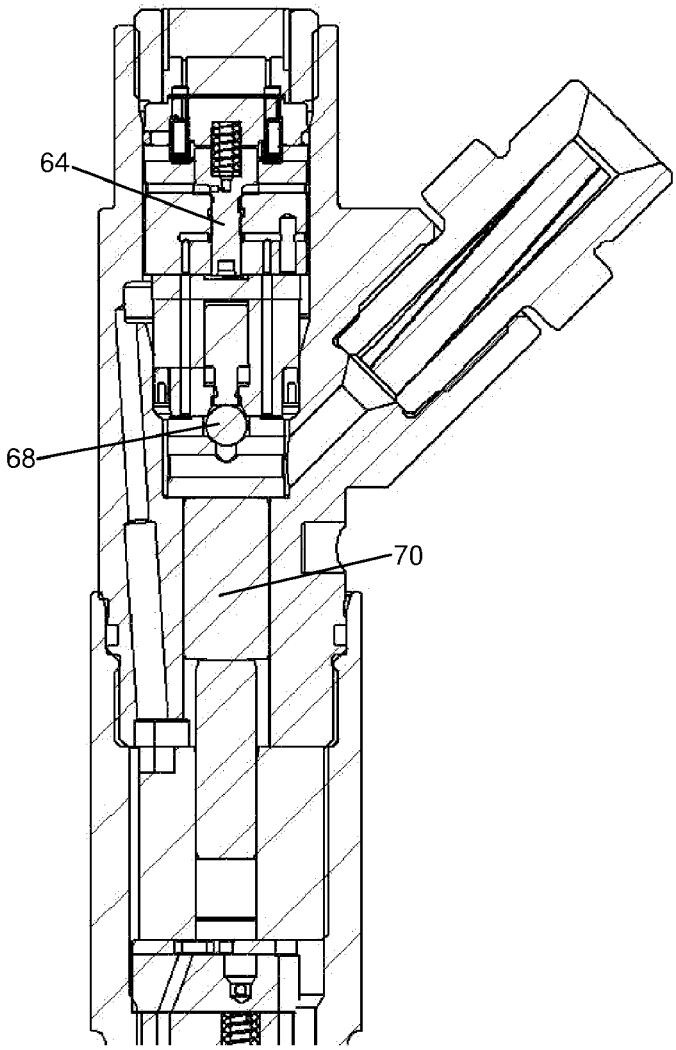
FIG. 5 presents the cross-section of the upper part of the injector of FIG. 4, taken on an expanded scale.
Figure 6:
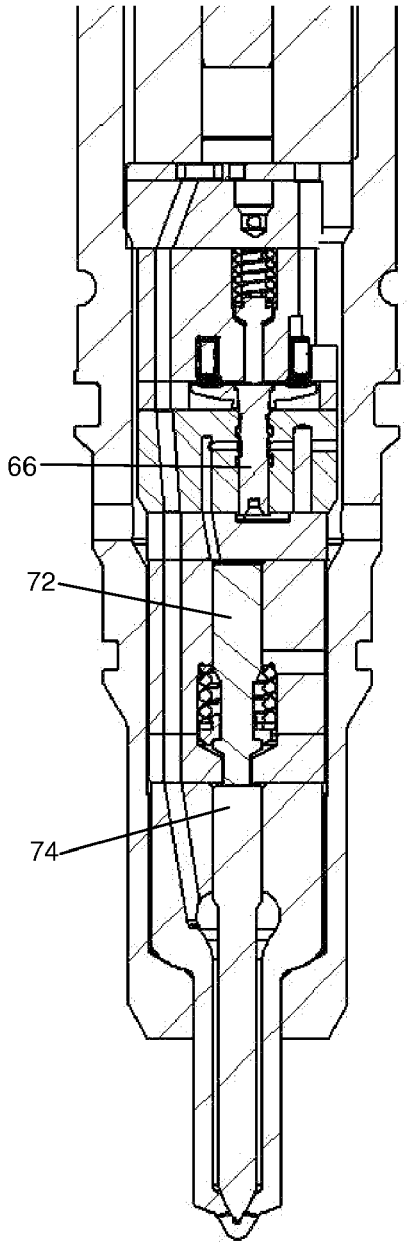
FIG. 6 presents the cross-section of the lower part of the injector of FIG. 4, taken on an expanded scale.

The valves of the present invention are well suited for various applications, one of which is in diesel fuel injectors. By way of example, FIG. 4 is a cross-section of an injector, with FIGS. 5 and 6 being cross-sections of the upper part and the lower part of the injector of FIG. 4, taken on a larger scale. Note that for clarity, FIGS. 5 and 6 each include a portion of the center of the injector. The injector shown is of the well-known intensifier type. It includes first and second three-way spool poppet valves 64 and 66 generally in accordance with FIGS. 3 and 1 of the present invention, and a three-way ball valve 68 also in accordance with FIG. 3 of the present invention. The three-way spool poppet valves are both electromagnetically actuated, though the two actuators are of somewhat different configurations, while the three-way ball valve is hydraulically actuated as in the embodiment of FIG. 3. Three-way spool poppet valve 64 controls pressure over the piston controlling the three-way ball valve 68 (see piston 50 in FIG. 3), that in turn controls pressure over the intensifier 70. Three-way spool poppet valve 66 provides direct needle control by directly controlling pressure over piston 72 in contact with the needle 74.

Figure 7:
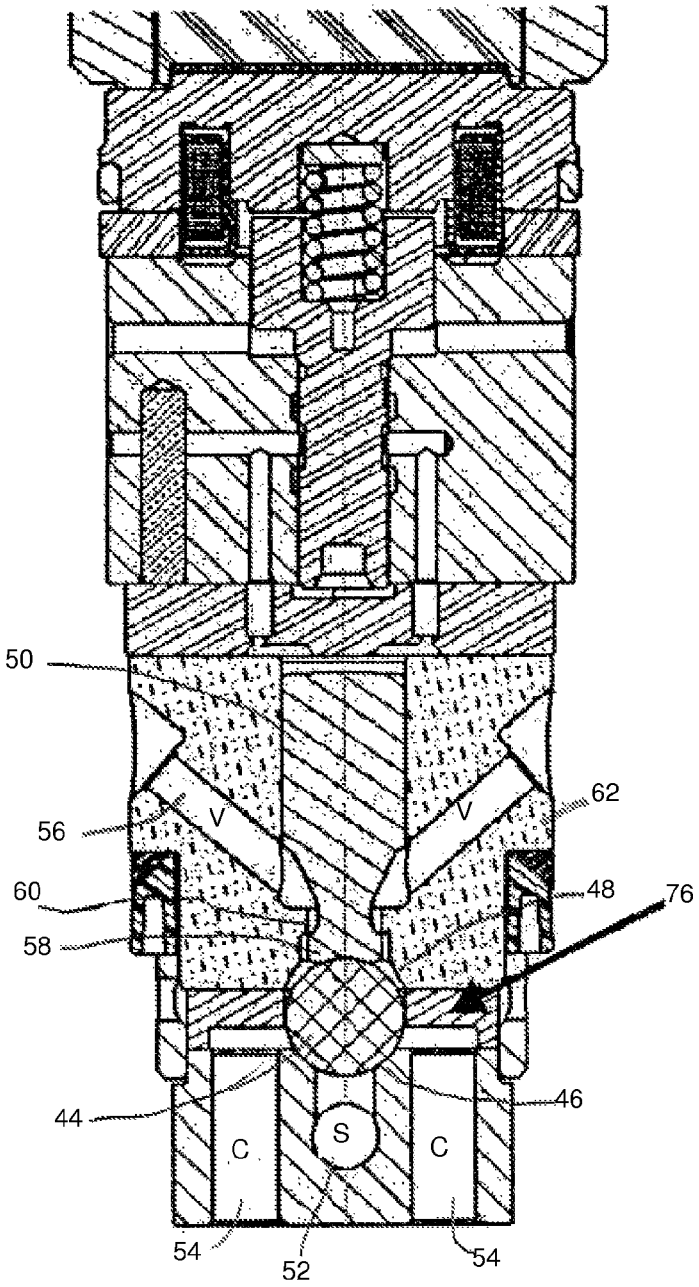
FIG. 7 illustrates a ball valve similar to that of FIGS. 3 and 4, though with a further improvement.

A further improvement on the ball valve 68 of FIGS. 3 and 4 may be seen in FIG. 7. This embodiment is similar to that of FIG. 3, and accordingly corresponding parts are similarly labeled. Like the embodiment of FIG. 3, this embodiment also incorporates integral spool valve-like land 58 on its end that cooperates with the land 60 on the inside of body member 62. As before, these perform like a normal spool valve, opening enough with the ball 44 in the lower position to provide an adequate flow passage between the control port 54 and the vent 56, but immediately beginning to close, and closing during the early part of the vertical motion of the ball to substantially limit the time and flow passage area during which the supply port 52 is in fluid communication with the vent port 56. Thus as before, the short circuit characteristic of such ball valves is not eliminated, but its effect is substantially reduced, thereby substantially improving the performance of the valve. In addition, however, in this embodiment orificed spacer 76 is added, defining a restricted flow path between the ball 48 and the orificed spacer 76. This restriction is chosen to allow adequate flow from ports 54 past the spool valve 58,60 to the vent ports 56 when the ball 44 is in the position shown in FIG. 7, but restricts flow from the supply (S) port 52 to the vent ports 56 as the ball moves away from the position shown toward its opposite position. In that regard, note that the orificed spacer 76 does not restrict flow from the supply (S) port 52 to the control (C) ports 54 when the ball 44 is in its upper most position. In the exemplary fuel injector application as described, the valve will spend most of the time in the position shown in FIG. 7, and exhibit very low leakage because of the ball 44 being forced onto the hard seat 46. For injection, the ball 44 will be forced upward against the hard seat 48 by the pressure from the supply 52 and the lack of pressure over the hydraulically actuated piston 50, again exhibiting very low leakage. During movement of the ball from the position venting the ports 54 coupled to the region over the intensifier, as shown, to its upper most position, the less flow past the ball to the vent (V) the better, as that flow is from the undesired hydraulic short circuit from the supply (S) directly to the vent(V). In fact, the flow restriction between the orificed spacer 76 and the ball 44 can be advantageous for the operation of the valve as the ball moves upward from the position shown, as the pressure drop caused by the restriction causes a greater differential pressure across the ball, helping to move the ball upward quickly and avoiding the initial high speed flow from the supply (S) and the control (C) past the ball 44, holding the ball in close proximity to the seat 46 to restrict the flow from the supply (S) to the control (C) during initiation of fuel intensification in the injector. On moving the ball 44 downward from its uppermost position to its lowermost position to stop intensification, the flow past the ball need only be enough to relieve the pressure on the FIG. 4) to return to their uppermost positions between injection events. In the embodiment shown, the fuel rail pressure is provided under the intensifier plunger 78 to displace the fuel between injection events from over the intensifier piston 70 to vent. Accordingly, the flow rate between the ball 44 and the orificed spacer 76 need only be adequate to achieve this at any power and speed. Thus the orificed spacer defines a circular cylindrical restriction around the ball, restricting flow to the minimum allowable to achieve the function of the three-way valve.

Thus the three-way spool poppet valves disclosed herein provide a substantially leak proof valve when in one position, yet preserve the advantages of a three-way spool valve. The ball valves of the present invention provide a substantially leak proof valve when in either position, as is characteristic of ball valves, though further include means for minimizing the short circuit flow path from a high pressure supply directly to a low pressure vent as the ball transitions from one position to the opposite position. These features are useful and advantageous in many applications, one of which is in fuel injectors, as also disclosed herein. Thus while certain preferred embodiments and applications of the present invention have been disclosed and described herein for purposes of illustration and not for purposes of limitation, it will be understood by those skilled in the art that various changes in form and detail may be made therein without departing from the spirit and scope of the invention.

What is claimed is:

1. A three-way valve comprising:

a valve housing having a spool valve bore diameter with a poppet valve seat disposed at one end thereof, the spool valve bore defining an axis along the spool valve bore, the poppet valve seat being axially fixed relative to the valve housing, the valve housing having a first annular groove in the spool valve bore diameter coupled to a first port, and a second annular groove;

a spool within the valve housing, the spool having a poppet valve thereon, the poppet valve not having an axial flow path there through, the spool having a spool land fitting within the spool valve bore diameter, the spool and the valve housing defining a first flow path between the second annular groove and the poppet valve seat, the spool also having a first relief separated from the first flow path by the spool land, the spool being moveable within the valve housing along the axis of the spool valve bore between a first position with the poppet valve positioned on the poppet valve seat and a second position with the poppet valve displaced from the poppet valve seat, the first annular groove in the valve housing and the first relief in the spool defining a second flow path between the first port in the valve housing and a second port in the valve housing and the land and poppet valve preventing flow through the poppet valve seat when the spool is in the first position, and the first relief, the land on the spool and the second annular groove in the valve housing, the first flow path and the poppet valve seat defining a third flow path between the second port and a third port and the spool preventing flow between the first port and the second port when the spool is in the second position.

2. The valve of claim 1 wherein the poppet valve seat has an inner diameter equal to the spool valve bore diameter and a poppet valve seat angle differing from an angle of the poppet valve so that the poppet valve seats on the inner diameter of the poppet valve seat, the first flow path between the spool and valve housing from the second annular groove to the poppet valve seat being defined by a second relief in the spool.

3. The valve of claim 1 further comprised of a solenoid actuator for moving the spool to the second position and a return spring disposed to encourage the spool to the first position.

4. The three-way valve of claim 1 further comprising a ball valve having:

a ball;

first and second coaxial valve seats, the ball being moveable between a first position wherein the ball is on the first valve seat and a second position wherein the ball is on the second seat, the first seat being coupled to a source of fluid under pressure, the second seat being coupled to a vent, and a region surrounding the ball between the two seats being coupled to a region in which the pressure is to be controlled;

a valve actuation member disposed to be forced against the ball to force the ball from the second position to the first position, the valve actuation member having a land thereon fitting within a bore coaxial with the second seat to allow flow through the second seat when the ball is in the first position, and to prevent flow through the second seat when the ball is between the first and second positions;

one of the second port and the valve seat being coupled to hydraulically actuate the valve actuation member.

5. The valve of claim 4 wherein the ball is surrounded by an orificed spacer between the first and second seats, the orificed spacer having a circular cylindrical opening surrounding the ball and providing a restriction in flow area between the ball and the orificed spacer.

6. The valve of claim 5 further comprised of a solenoid actuator for moving the spool to the second position and a return spring disposed to encourage the spool to the first position.

7. The three-way valve of claim 1 wherein the spool and valve housing are configured to block the flow path between the first port in the valve housing to the second port in the valve housing before defining the flow path from the first port through the poppet valve seat.

8. The three-way ball valve of claim 7 further comprising:

a ball;

first and second coaxial valve seats, the ball being moveable between a first position wherein the ball is on the first valve seat and a second position wherein the ball is on the second seat, the first seat being coupled to a source of fluid under pressure, the second seat being coupled to a vent, and a region surrounding the ball between the two seats being coupled to a region in which the pressure is to be controlled;

a valve actuation member disposed to be forced against the ball to force the ball from the second position to the first position, the valve actuation member having a land thereon fitting within a bore coaxial with the second seat to allow flow through the second seat when the ball is in the first position, and to prevent flow through the second seat when the ball is between the first and second positions;

the second port being coupled to hydraulically actuate the valve actuation member.

9. The valve of claim 8 wherein the ball is surrounded by an orificed spacer between the first and second seats, the orificed spacer having a circular cylindrical opening surrounding the ball and providing a restriction in flow area between the ball and the orificed spacer.

10. The valve of claim 9 further comprised of a solenoid actuator for moving the spool to the second position and a return spring disposed to encourage the spool to the first position.

* * * * *